US008584321B2

(12) United States Patent
Trautner et al.

(10) Patent No.: US 8,584,321 B2
(45) Date of Patent: Nov. 19, 2013

(54) DOOR HINGE FOR OPENING AND CLOSING A DOOR OF A DOMESTIC APPLIANCE

(75) Inventors: Andreas Trautner, Neuendettelsau (DE); Christoph Bluml, Schillingsfurst (DE)

(73) Assignee: Electrolux Home Products Corporation N.V., Brussels (BE)

( * ) Notice: Subject to any disclaimer, the term of this patent is extended or adjusted under 35 U.S.C. 154(b) by 0 days.

(21) Appl. No.: 13/265,147

(22) PCT Filed: Apr. 29, 2010

(86) PCT No.: PCT/EP2010/002626

§ 371 (c)(1),
(2), (4) Date: Oct. 19, 2011

(87) PCT Pub. No.: WO2010/127803

PCT Pub. Date: Nov. 11, 2010

(65) Prior Publication Data

US 2012/0036681 A1 Feb. 16, 2012

(30) Foreign Application Priority Data

May 8, 2009 (EP) ..... 09006265

(51) Int. Cl.
*E05D 11/10* (2006.01)

(52) U.S. Cl.
USPC ..... 16/352; 16/374

(58) Field of Classification Search
USPC ..... 16/286, 287, 257, 260, 261, 263, 323, 16/324; 126/191, 192, 194; 49/386, 389
See application file for complete search history.

(56) References Cited

U.S. PATENT DOCUMENTS

| | | | | | |
|---|---|---|---|---|---|
| 821,861 | A | * | 5/1906 | Croft | 16/352 |
| 3,006,335 | A | | 10/1961 | Keeling | |
| 3,299,879 | A | * | 1/1967 | Doner | 126/194 |
| 3,327,701 | A | | 6/1967 | Gibbons | |
| 3,368,423 | A | * | 2/1968 | Fazekas et al. | 74/165 |
| 3,712,287 | A | * | 1/1973 | Summers, Jr. | 126/191 |
| 3,811,150 | A | * | 5/1974 | Chalmers | 16/352 |

(Continued)

FOREIGN PATENT DOCUMENTS

| | | | |
|---|---|---|---|
| FR | 2398165 | A * | 3/1979 |
| GB | 996535 | | 6/1965 |
| GB | 2252787 | A * | 8/1992 |

OTHER PUBLICATIONS

International Search Report for PCT/EP2010/002626, dated Jun. 28, 2010, 2 pages.

*Primary Examiner* — Chuck Mah
(74) *Attorney, Agent, or Firm* — Pearne & Gordon LLP

(57) ABSTRACT

Door hinge (10) for opening and closing a door of a domestic appliance, in particular an oven, comprising a hinge arm (12), a hinge lever (14) pivotally fixed to the hinge arm (12), and biasing means for biasing the door hinge (10) in its closed position, wherein a locking device is provided for locking the door hinge (10) in a predetermined opening position, wherein the locking device comprises a locking member (22), which is fixed to the hinge arm (12) in a linearly movable manner, and a locking recess (34) formed at the hinge lever (14), wherein the locking member (22) and the locking recess (34) can selectively be brought into locking engagement with each other in the predetermined opening position of the door hinge (10).

10 Claims, 1 Drawing Sheet

(56) References Cited

U.S. PATENT DOCUMENTS

| | | | | |
|---|---|---|---|---|
| 4,163,344 | A * | 8/1979 | Scherer | 49/386 |
| 4,287,873 | A * | 9/1981 | Goins et al. | 126/194 |
| 6,353,968 | B1 * | 3/2002 | Shyu et al. | 16/334 |
| 2003/0172920 | A1 * | 9/2003 | Gronbach | 126/197 |
| 2006/0032019 | A1 * | 2/2006 | Kistner et al. | 16/286 |
| 2007/0283532 | A1 * | 12/2007 | Vanini | 16/277 |
| 2010/0229345 | A1 * | 9/2010 | Donoho | 16/374 |

* cited by examiner

DOOR HINGE FOR OPENING AND CLOSING A DOOR OF A DOMESTIC APPLIANCE

BACKGROUND

1. Technical Field

The present invention relates to a door hinge for opening and closing a door of a domestic appliance, in particular an oven, comprising a hinge arm, a hinge lever pivotally fixed to the hinge arm and biasing means for biasing the door hinge in its closed position, wherein a locking device is provided for locking the door hinge in a predetermined opening position. Moreover, the present invention relates to an oven comprising a housing and a door, which is fixed to the housing by means of such door hinges.

2. Description of Related Art

Door hinges of the above mentioned kind are known in prior art. They are particularly used for the assembly of oven doors. During the assembly process the hinge arms of normally two door hinges are initially fixed to the oven housing. Then the oven door is fastened to the hinge levers of the door hinges, whereupon the oven door can be pivotally opened and closed by a user. In order to ensure a proper closing of the door, each door hinge is provided with biasing means for biasing the door hinge or rather the oven door in its closed position.

Moreover, ovens are known whose doors can be disassembled by a user in order to simplify the cleaning of the oven. Such ovens normally comprise a locking device for locking each door hinge in a predetermined opening position in order to prevent a snapping back of the hinge levers towards the closed position. This is because it is very difficult for the user to manually return the hinge levers against the force of the biasing means when re-assembling the oven door.

An oven having such locking devices is disclosed in DE-A-6 943 499. The oven comprises a housing and a door, which is fixed to the housing by means of two door hinges. Each door hinge has a hinge arm, which is fixed to the housing, and a hinge lever to which the oven door is attached. Moreover, each door hinge is provided with a snap-fitting plate, whose first free end is guided within a longish slit formed in the hinge lever and whose other free end is operatively connected to a spring, which biases the hinge lever along with the snap-fitting plate in the closed position of the door hinge. As soon as the oven door is moved upwards along the hinge levers during the disassembly of the door, the snap-fitting plates can be pivoted and locked under the influence of the springs. To do so, the door firstly needs to be moved in its predetermined opening position. Thereafter, it is drawn upwards a little bit and then tilted in order to turn and lock the snap-fitting plates of the door hinges. Afterwards the door can be removed from the hinge levers, which rest in the predetermined opening position.

One drawback of the door hinge disclosed in DE-A-6 943 499 is that the structure of the locking device is quite complex and thus expensive. Moreover, the locking device needs a lot of installation room. Furthermore, the user needs knowledge about how to manipulate the locking device, because the manipulation is not apparent from its outer appearance.

SUMMARY

It is an object of the present invention to provide a door hinge of the above mentioned kind, which has a simple structure and needs only little installation space. Moreover, the manipulation of its locking device should be recognizable by means of its outer appearance.

In order to solve this object the present invention provides a door hinge of the above mentioned kind, which is characterized in that the locking device comprises a locking member, which is fixed to the hinge arm in a linearly movable manner, and a locking recess formed at the hinge lever, wherein the locking member and the locking recess can selectively be brought into locking engagement with each other in the predetermined opening position of the door hinge. In other words, the present invention proposes to use a simple structured slider as the locking means, which needs little installation space. Moreover, its manipulation is obvious for every user.

Preferably the predetermined opening position of the door hinge corresponds to an opening angle of the door between 45° and 65°, in particular 55°. Such an opening angle guaranties a comfortable disassembly of the door from the hinge levers.

According to one aspect of the present invention, guiding means are provided for guiding the linear movement of the locking member. Preferably, these guiding means comprise at least two longish guiding slots in which guiding pins are inserted. At least one of these guiding pins can also function as a fixing means for movably fixing the locking member to the hinge arm.

Preferably the locking member comprises an actuation means, which simplifies the manipulation of the locking member by a user. For example, the actuation means is provided as a lug projecting upwards from the locking member.

The locking member can be made of a flat material, in particular a metal strip. This leads to a very simple and inexpensive construction.

Preferably, the hinge arm is formed in such a manner that it can be inserted in a corresponding opening formed at the bottom side of the door. Accordingly, the door can be attached to the hinge arms in a simple and comfortable manner.

According to one aspect of the present invention, the hinge arm has a fin-like shape.

Moreover, the present invention provides an oven comprising a housing and a door fixed to the housing by means of door hinges of the above described structure.

BRIEF DESCRIPTION OF THE DRAWINGS

Further features and advantageous of the present invention will become apparent by means of the following description of an embodiment of a door hinge of the present invention with reference to the accompanying drawing, wherein.

DETAILED DESCRIPTION

Figure 1:
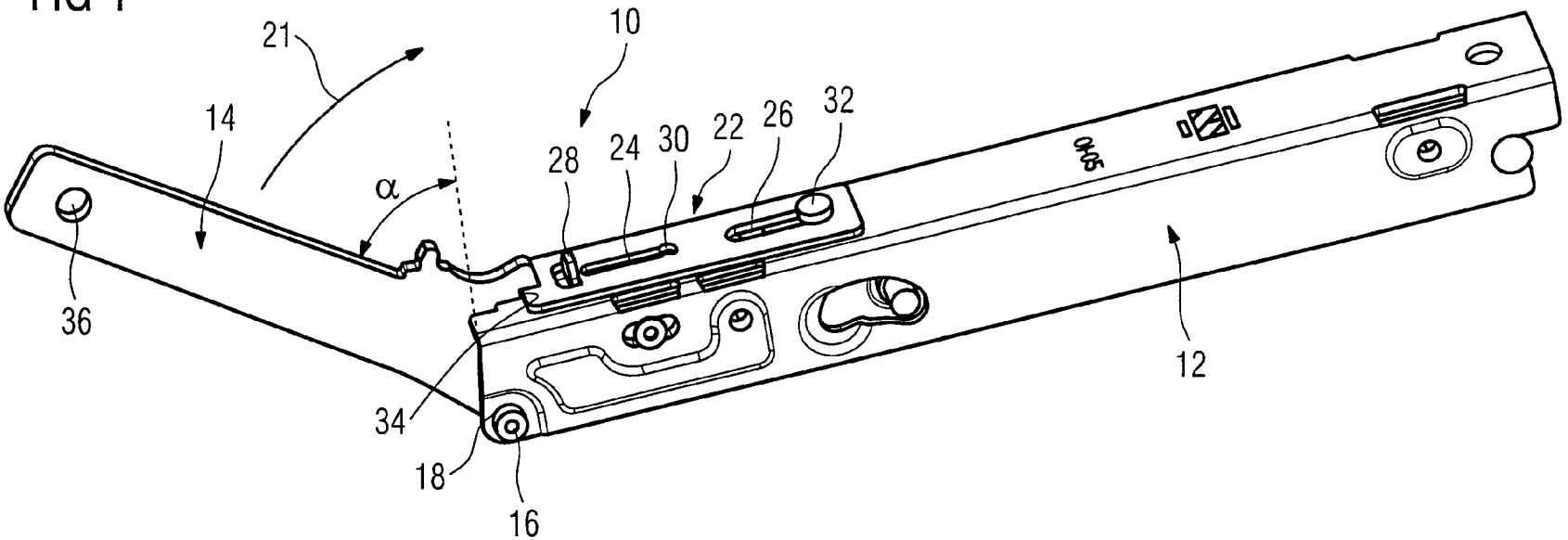
FIG. 1 is a perspective view of a door hinge according to an embodiment of the present invention and FIG. 2 is a top view of a hinge lever of the door hinge shown in FIG. 1.
Figure 2:
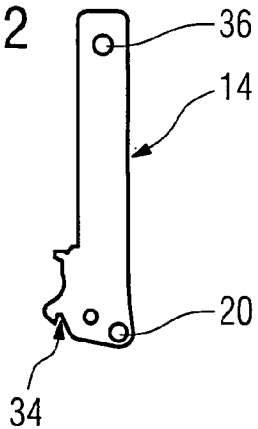

FIG. 1 shows a door hinge 10 according to an embodiment of the present invention, which is particularly used for pivotally fixing an oven door to an oven housing. The door hinge 10 comprises a hinge arm 12 to be fixed at the oven housing and a hinge lever 14 for receiving the oven door. These two components are pivotally fixed to each other by means of a pivot pin 16 extending through corresponding pivot pin openings 18 and 20, which are formed at the hinge arm 12 and the hinge lever 14, respectively. The hinge lever 14 is operatively connected to a conventional biasing means in form of a spring (not shown) for biasing the door hinge 10 in its closed position, as it is denoted by the arrow 21.

The door hinge 10 is provided with a locking device for locking the door hinge 10 in a predetermined opening position. The locking device comprises on the one hand a locking member 22, which is made of a flat metal strip and arranged at the upper side of the hinge arm 12. The locking member 22 is provided with two longish guiding slits 24 and 26, which are lined with each other and extend towards the hinge lever 14. Moreover, the locking member 22 comprises an actuation means 28 to be manipulated by a user, which is provided as a lug made integral with and projecting upwards from the locking member 22. Two rivet-like guiding pins 30 and 32, which are fixed to and project upwards from the hinge arm 12, are inserted in the longish slits 24 and 26, respectively, such that the locking member 22 can perform a linear back and forth movement guided and limited by the guiding slits 24 and 26. The guiding pin 32 also functions as a fixing means for movably fixing the locking member 22 to the hinge arm 12. On the other hand, the locking device comprises a locking recess 34 provided at the hinge lever 14. The locking recess 34 is formed at the hinge lever 14 at such a position, that the locking member 22 can be brought into locking engagement with the locking recess 34 at a predetermined opening position of the door hinge 10. This predetermined opening position presently corresponds to an opening angle $\alpha$ between the hinge arm 12 and the hinge lever to 14 of 55°. Such an opening angle ensures an easy and comfortable assembling and disassembling of the oven door.

In the assembled state of the oven the oven door is pivotally fixed to the oven housing by means of two door hinges 10. More precisely, the hinge arms 12 of the door hinges 10 are attached to the oven housing, and the fin-shaped hinge levers 14 are inserted in corresponding openings formed at the bottom side of the oven door, wherein the oven door is held at the hinge levers 14 via fixing means, which are releasably received in fixing openings 36 formed close to the free end of each hinge lever 14.

In order to remove the oven door from the oven housing, the user firstly has to open the door by the predetermined opening angle $\alpha$. Thereafter, he can manipulate the locking member 22 of each door hinge 10 such that they perform a linear movement guided by the guiding slit 24, 26 and the guiding pins 30, 32, until each locking member 22 engages with the associated locking recess 34. Thus, the door hinges 10 are locked in their predetermined opening position. Now the user can release the fixing means from the fixing openings 36 and pull the oven door from the fin-shaped hinge levers 14.

The reassembly can be effected in reversed order.

The invention claimed is:

1. A door hinge (10) for opening and closing a door of a domestic appliance, the door hinge comprising:

a hinge arm (12) fixed to a housing of the domestic appliance;

a hinge lever (14) pivotally fixed to the hinge arm (12), the hinge lever (14) being configured to receive the door of the domestic appliance; and biasing means configured to bias the door hinge (10) in a closed position; and a locking device configured to lock the door hinge (10) in a predetermined opening position, the locking device comprising a locking member (22) and a locking recess (34), the locking member (22) being fixed to the hinge arm (12) in a linearly movable manner, the locking recess (34) being formed at the hinge lever (14), the locking member (22) and the locking recess (34) being selectively brought into locking engagement with each other in the predetermined opening position of the door hinge (10).

2. The door hinge (10) according to claim 1, wherein the predetermined opening position of the door hinge (10) corresponds to an opening angle (2) of the door between 45° and 65°.

3. The door hinge (10) according to claim 1, further comprising:

a guiding means configured to guide the linear movement of the locking member (22).

4. The door hinge (10) according to claim 3, wherein the guiding means comprises at least two longish guiding slots (24, 26) in which guiding pins (30, 32) are inserted.

5. The door hinge (10) according to claim 4, further comprising:

a fixing means configured to movably fix the locking member (22) to the hinge arm (12), the fixing means comprising at least one of the guiding pins (32).

6. The door hinge (10) according to claim 1, wherein the locking member (22) comprises an actuation means (28) configured to simplify a, manipulation of the locking member (22).

7. The door hinge (10) according to claim 6, wherein the actuation means (28) comprises a lug projecting upwards from the locking member (22).

8. The door hinge (10) according to claim 1, wherein the locking member (22) comprises a flat material, the flat material comprising a metal strip.

9. The door hinge (10) according to claim 1, wherein the hinge lever (14) is configured to be inserted in a corresponding opening formed at a bottom side of the door.

10. The door hinge (10) according to claim 9, wherein the hinge lever (14) has a fin-like shape.

* * * * *